US008128522B1

(12) United States Patent
Rangel

(10) Patent No.: US 8,128,522 B1
(45) Date of Patent: Mar. 6, 2012

(54) VARIABLE LENGTH FLETCHING SYSTEM AND METHOD FOR USING THE SAME

(76) Inventor: Louis Rangel, Phelan, CA (US)

( * ) Notice: Subject to any disclaimer, the term of this patent is extended or adjusted under 35 U.S.C. 154(b) by 439 days.

(21) Appl. No.: 12/276,413

(22) Filed: Nov. 23, 2008

Related U.S. Application Data

(63) Continuation-in-part of application No. 10/932,164, filed on Sep. 1, 2004, now Pat. No. 7,455,605.

(60) Provisional application No. 60/499,553, filed on Sep. 2, 2003.

(51) Int. Cl.
*F42B 6/06* (2006.01)

(52) U.S. Cl. ..... 473/586

(58) Field of Classification Search ..... 473/578, 473/585, 586; 428/43, 136
See application file for complete search history.

(56) References Cited

U.S. PATENT DOCUMENTS 2,532,664 A * 12/1950 Freedman ..... 281/5
2,830,818 A 4/1958 Otto
3,815,916 A 6/1974 Meszaros
3,922,401 A 11/1975 Bear
4,176,479 A * 12/1979 I'Hoir ..... 40/672
4,204,307 A 5/1980 Pfetzing
4,234,192 A 11/1980 Salamone
4,583,745 A 4/1986 Ladner
4,606,555 A * 8/1986 Adams ..... 283/52
4,615,552 A 10/1986 Bengtson
5,427,385 A 6/1995 Conrad et al.
5,443,272 A 8/1995 Vincent, Sr.
5,443,273 A 8/1995 Lovorn
6,641,493 B1 11/2003 Shifflett

* cited by examiner

*Primary Examiner* — John Ricci
(74) *Attorney, Agent, or Firm* — R. Dabney Eastham

(57) ABSTRACT

An arrow fletching system having a continuous roll or individual lengths of base material to which is applied a series of fins or vane segments. The benefit of this fletching system is that an arrow can be fletched with an equal number of vane segments in each fletching area without measuring and/or weighing each of the sections. This results in a balanced arrow which can be easily modified to add or reduce the number of segments. Fins or vane segments may by slitted for greater flexibility along their top edges.

15 Claims, 7 Drawing Sheets

PRIOR ART

VARIABLE LENGTH FLETCHING SYSTEM AND METHOD FOR USING THE SAME

CROSS-REFERENCE TO RELATED APPLICATIONS

This application is a continuation-in-part of U.S. patent application Ser. No. 10/932,164 entitled "Variable Length Fletching System and Method for Using Same" filed on Sep. 1, 2004, which claims priority from Provisional Patent Application Ser. No. 60/499,553, entitled "Variable Length Fletching System and Method for Using Same," filed on Sep. 2, 2003.

STATEMENT REGARDING FEDERALLY SPONSORED RESEARCH OR DEVELOPMENT

Not applicable.

FIELD

The present invention relates to the sport of archery, and more particularly with respect to the feathering or flight guiding, retarding, stabilizing, or controlling means of an arrow.

BACKGROUND

Current arrow fletching usually comprises three vanes or feathers which are each made of a continuous vane material. This vane material has a base which is slightly wider than the vane so as to increase the surface area for bonding with the arrow shaft. During use of the arrow, the vane material may become damaged with a tear or a hole due to the passage of a subsequently shot arrow through the vane material or by passing into or through the target itself. Because the vanes are typically made of a one-piece material, the vane cannot deform sufficiently to avoid damage.

When determining the appropriate length of fletching on an arrow, a trial and error method is typically employed. With not enough fletching, the flight of the arrow shaft will be erratic. With too much fletching material, the arrow will become too heavy and will cause additional drag due to the unnecessary fletching material. The arrow may also be unbalanced. Unfortunately, there is no easy method for removing identical amount of fletching from each of the three vanes when experimenting to provide the appropriate amount of fletching material.

SUMMARY

Embodiments of the present invention relate to a method and apparatus for varying the length of a vane used in fletching on an arrow shaft. More specifically, embodiments relate to dispensing vane material in a segmented fashion so that the length of the vane may be altered prior to and/or after adhering the vane to the arrow shaft.

Certain embodiments of the present invention comprise a roll or length of fletching material or vane having repeating fins or vane segments over a continuous base section. The continuous base section allows the repeating fins or vane segments to remain together during storage while allowing the fins or vane segments to be easily separated and severed for use. The base section also provides for additional surface area for adhesive to bond the fletching material to the arrow shaft. The provision of fins or vane segments also allow for easy adjustment of the length of fletching on an arrow shaft. For example, if an archer creates an arrow and fletches it with three equal lengths of fletching comprising five fins or vane segments each, and if the archer then decides that there is too much fletching, one fin or vane segment can easily be removed from each of the three lengths of fletching. In this manner, an equal amount of fletching will be removed and the arrow will remain balanced. Likewise, fins or vane segments may be severed from the roll or length of fletching material and an equal number added to each of the fletchings on the arrow shaft to provide additional arrow control. In this manner, an arrow may be easily modified to achieve a particular balance while retaining symmetry across the fletchings of the arrow.

Further, certain embodiments of the present invention comprise repeatable fins or vane segments that are more flexible and pliable than prior art vanes. Fins or vane segments in accordance with this embodiment of the present invention are thus more likely be deflected from the flight path of another arrow, thereby reducing and/or preventing damage to the vane that may otherwise result.

Fins or vane segments in accordance with selected embodiments of the present invention may comprise various sizes and shapes arranged in a repeatable pattern such that trial and error testing may be utilized to determine an appropriate length of fletching. Once such an appropriate length is ascertained, the user may then fletch other arrows of similar dimension and weight by simply determining the number and shape of the vane segments attached to a properly balanced arrow and mirroring such fletching on the other arrows.

In another embodiment of the invention, repeating fins or vane segments attached to a base material are made of a synthetic material. The fins or vane segments are provided with slits extending from their top edges toward the base material so as to provide flexibility along the top edge of each fin or vane segment to minimize impact with a bow window or shelf. A synthetic material vane that is of sufficient size and shape as to be used as a fletching by itself may also be provided with slits extending from its top edge toward the base material so as to provide flexibility along the top edge of the vane for contact with a bow window or shelf.

DETAILED DESCRIPTION OF THE PREFERRED EMBODIMENTS

As used in this specification, the term "fletching" or "fletching material" refers to feathers or vanes, or an arrangement thereof, on an arrow. The term "nock" refers to the part of an arrow having a notch for the bowstring.

Figure 2:
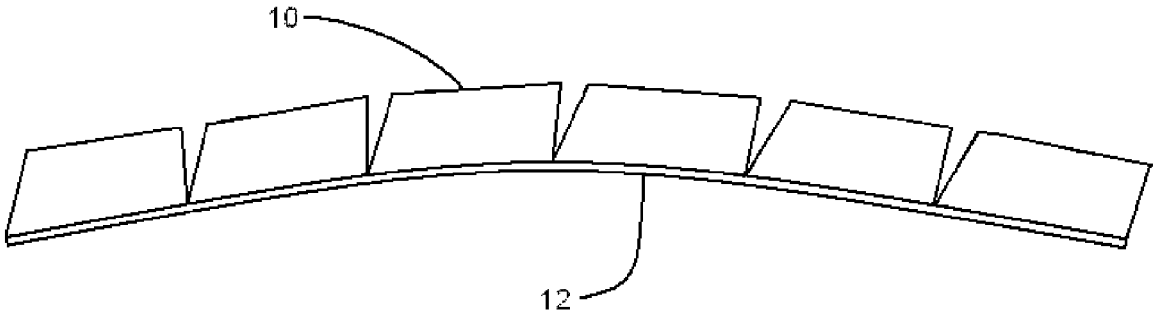
FIG. 2 is a side view of adjustable fletching material according to an embodiment of the invention showing multiple fins or vane segments connected by a continuous base material.

As shown in FIG. 2, embodiments of the present invention relate to a system and method for dispensing and/or allocating fletching material comprising a continuous roll of or length of base material 12 to which is affixed a continuous series of repeating vane segments 10 having the form of fins, or, alternatively, individual lengths of base material 12 having repeatable fins or vane segments 10 attached thereto.

Figure 3:
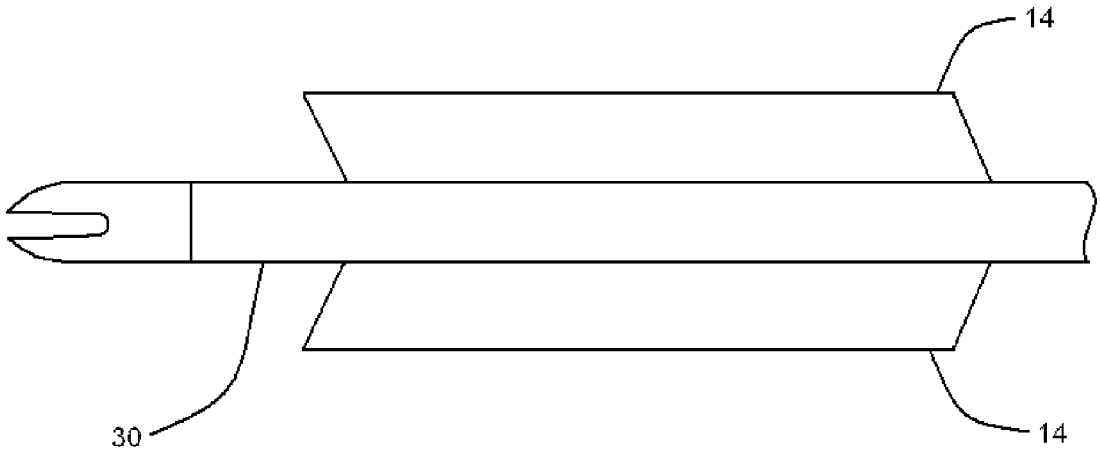
FIG. 3 is a side view of the prior art.

FIG. 3 depicts a prior art example showing single vanes or feathers 14 attached to the arrow shaft 30.

Figure 1:
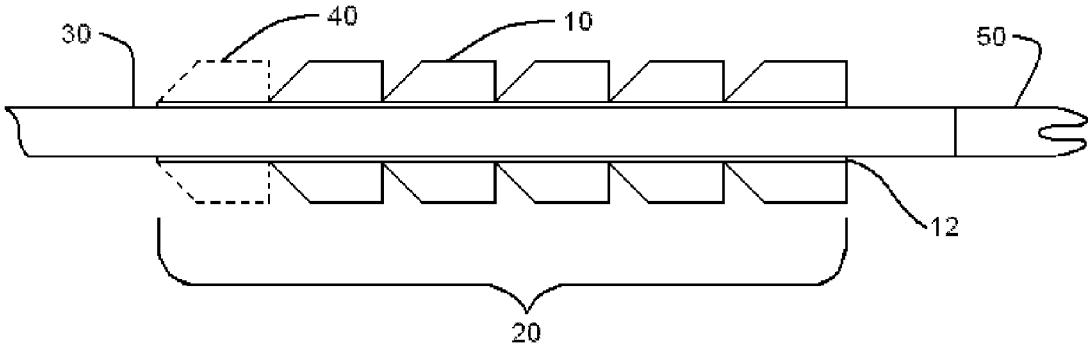
FIG. 1 is a side view of an arrow shaft having placed thereon a five fin or vane segment section 10 of adjustable fletching material according to an embodiment of the invention. In dashed lines a sixth fin or vane segment is shown where it would be positioned if additional fletching material was determined to be required or removed.

As depicted in FIG. 1, the fins or vane segments 10 may comprise identical lengths and shapes to facilitate symmetry between fletching areas 20 of the arrow. Indeed, where fins or vane segments 10 are of uniform size and shape, fletching areas 20 may be easily modified and by adding and/or removing fins or vane segments 10 without disrupting fletching balance. Any number of fins or vane segments 40 may be removed or added to fine tune the balance of the arrow shaft and/or to reduce drag, thus enabling an archer to maximize his chances of accuracy. Ideally, the user may optimize the arrow's speed by minimizing its weight, and it balance at 60-65 percent forward weight by adding or removing the requisite amount of fins or vane segments 40. Furthermore, the user may optimize the arrow's aerodynamics by minimizing the amount of fins or vane segments 40, including having only a single fin or vane segment 40.

Ultimately, the present invention gives the user control to instantly adjust the height of the vane's frontal area and the length of duration in which the arrow stabilizes in flight. By dramatically increasing the fletching's frontal area, the user dramatically improves the way the fletching engages the air, while dramatically reducing the length of the fletching area 20, and even the number of vane on the arrow shaft. The weight of the arrow is in turn reduced and the speed of the arrow's flight increases, potentially several feet per second. This increased speed allows the user to shoot the arrow in a flatter trajectory, thus improving the accuracy of the arrow.

Alternatively, vane segments 10 may vary as to length and shape, provided that such segments are arranged in a repeating pattern. In this manner, symmetry between vanes may be maintained while enabling a greater degree of selectivity with respect to the amount of fins or vane segments 40 that may be added or removed from each of the fletching areas 20 to maximize arrow speed and achieve a particular arrow balance. The present invention teaches the base portion 12 may be easily severed from a contiguous line of fletching and adhered to the arrow shaft 30 near the nock 50, thus allowing a user to bind the fins or vane segments 40 to the shaft 30 in desired lengths. Such bonding may comprise adhesive bonding, mechanical bonding, or any other bonding means known to those in the art.

Fletching that provides repeating fins or vane segments facilitate predictable performance in arrows having the same or nearly identical dimensions as such arrows may be uniformly fletched with the same quality and quantity of fins or vane segments. This reduces consumer waste that occurs during the trial and error process commonly used to obtain symmetry and balance with respect to each individual arrow.

Further, fletching that provides repeating fins or vane segments reduce product identification and inventory problems resulting when numerous product codes are used to identify different lengths of the same fletching material. Indeed, a method of fletching as described in this specification simplifies product identification and inventory by enabling use of a single product code in connection with a particular fletching material, since the particular length of fletching material may be customized according to a purchaser's needs. In this manner, costs associated with both marketing and utilizing the fletching material may be reduced.

The segmented nature of the fins or vane segments in accordance with the present invention also enables the fins or vane segments to avoid damage from other arrows or target pass-through. Indeed, such segments increase the flexibility of the fins or vane segments and also the ability of the fins or vane segments to deflect from the flight path of oncoming arrows.

Finally, the size and shape of the fins or vane segments enable an arrow to achieve superior aerodynamics, thereby resulting in increased flight distance.

Figure 4:
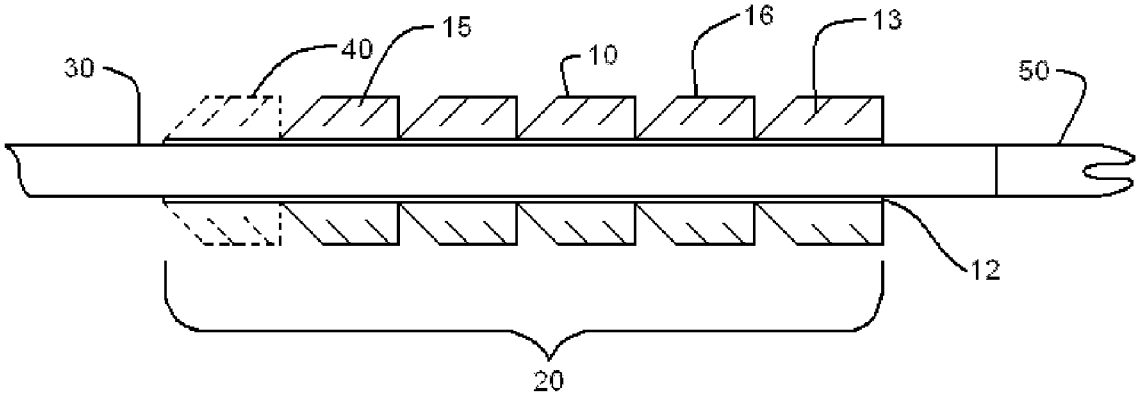
FIG. 4 is a side view of an arrow shaft having placed thereon a five fin or vane segment section 10 of adjustable fletching material according to another embodiment of the invention in which the fins or vane segments are made of synthetic material and slits are provided for flexibility. In dotted lines a sixth fin or vane segment is shown where it would be positioned if additional fletching material was determined to be required or removed.
Figure 5:
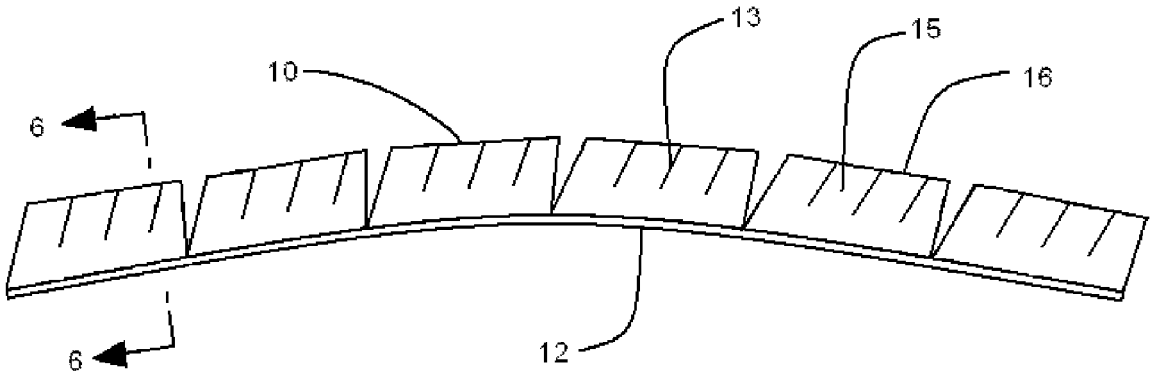
FIG. 5 is a side view of adjustable fletching material according to the embodiment of the invention of FIG. 4 showing fins or multiple vane segments connected by a continuous base material.
Figure 6:
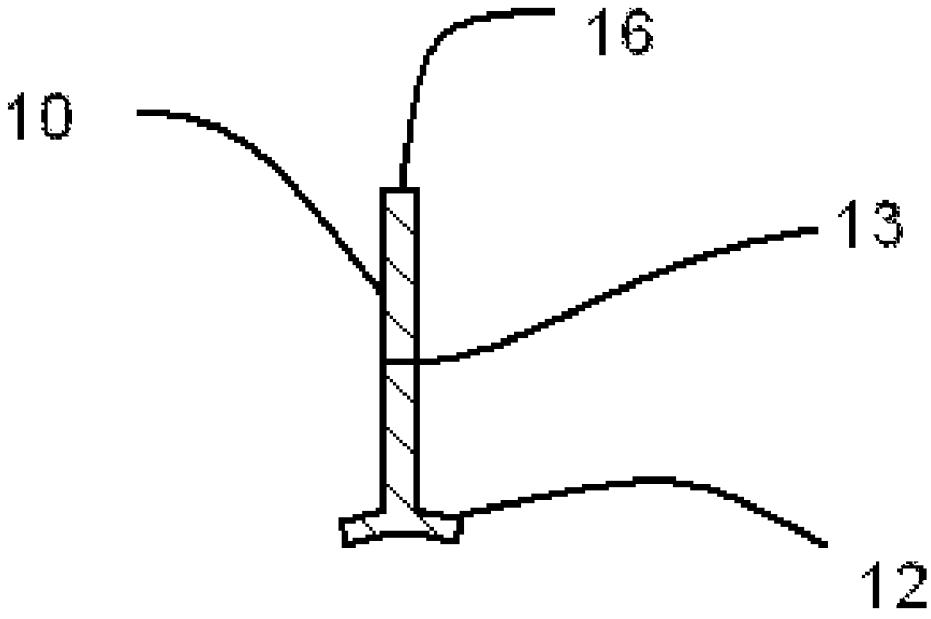
FIG. 6 is a sectional view of adjustable fletching material according to the embodiment of the invention of FIG. 4 taken along the line 6-6 in FIG. 5.

It will be recognized by those of skill in the art that the fletching described above in connection with FIGS. 1 and 2, and the prior art fletching of FIG. 3, could be made from the "vane" of a bird's pennaceous feather (the part above the downy portion of the feather) or from extruded synthetic material such as polyurethane or polyvinyl or any other material customarily used in fletching. FIGS. 4-6 depict another embodiment of fletching according to the invention, in which the fletching is made of a continuous synthetic material. The fins or vane segments 10 (this discussion also includes the fin or vane segment 40) are provided with slits 13 that extend through the fins or vane segments 10 from the top edge 16 of the fins or vane segments 10 toward the base material 12. The slits 13 may be generally parallel to each other and may be cut into the fins or vane segments 10 when the fins or vane segments 10 are cut from an extruded length of synthetic material.

The slits 13 divide the upper parts of the fins or vane segments 10 into generally similar, adjacent, and aligned strips 15. The strips 15 will be roughly comparable to the barbs of the vane of a bird's feather and the base material 12 will then correspond to the rachis or shaft of the vane of a bird's feather. Dividing the fins or vane segments 10 into generally similar, adjacent, and aligned strips 15 will give the fletching of FIGS. 4-6 more flexibility when contacting an arrow rest or bow window or shelf during a shot. As noted in U.S. Pat. No. 4,615,552 to Bengtson for "Fletching for Stabilizing Arrow Flight" (the disclosure of which is incorporated by reference in its entirety), at column 1, lines 30-57, the fletching of an arrow may contact the arrow rest or the bow handle during the shot and this will cause "porpoising" or "fishtailing" of the arrow. The stiffer the material of the arrow fletching the more "wobble" of this kind is produced. Fletching made of more flexible material will tend to have less wobble and less arrow deviation Bird feathers are noted for causing less flight deviation due to contact with an arrow rest or bow handle during a shot and are thus more "forgiving." Bird feathers vary considerably in thickness and stiffness, however, and are more susceptible to changes in humidity that fletching made of synthetic material.

The slits 13 that extend through the fins or vane segments 10 from the top edge 16 of the fins or vane segments 10 toward the base material 12 make the top edges 16 more flexible to avoid "wobble" in the arrow's flight. The slits 13 should not extend all the way to the base material 12. The portion of the fin or vane segments 10 adjacent to the base material 12 should not be slit in order to provide sufficient rigidity to each fin or vane segment 10 to avoid flutter in the flight of the arrow and have good flight performance. Preferably, the slits 13 should terminate at a height "B" above the base material 12 that is one third to two thirds the total height "H" of the fin or vane segment 10 above the base material 12. (The heights "H" and "B" are illustrated in connection with the embodiment of a fletching 100 shown in FIG. 7.)

Figure 7:
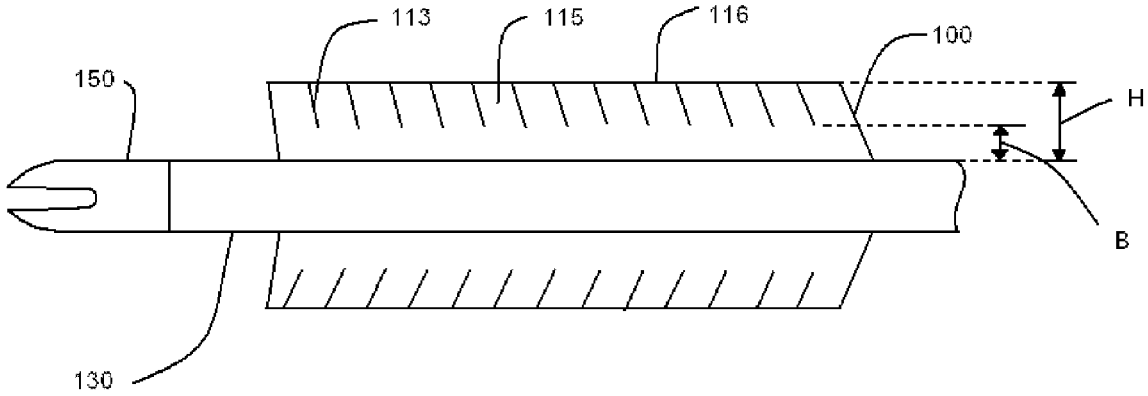
FIG. 7 is a side view of an arrow shaft having placed thereon a fletching vane made of synthetic material in which slits are provided for flexibility.

The performance of unitary fletchings made of synthetic material, that is, fletchings made of synthetic material that consist of one vane, also may be improved by providing slits. FIG. 7 shows a fletching 100 made of synthetic material and mounted on an arrow shaft 130. The fletching 100 has slits 113 that extend through the fletching 100 from the top edge 116 of the fletching 100 toward the base material 112. The slits 113 may be generally parallel to each other and may be cut into the fletching 100 when it is cut from an extruded length of synthetic material. The slits 113 divide the upper part of the body of the fletching 100 into generally similar, adjacent, and aligned strips 115.

The slits 113 that extend through the fletching 100 from the top edge 116 of the fletching 100 toward the base material 112 make the top edges 116 more flexible to avoid "wobble" in the arrow's flight. The portion of the body of the fletching 100 that is adjacent to the base material 12 should not be slit in order to provide sufficient rigidity to the fletching 100 to avoid flutter in the flight of the arrow and have good flight performance. Preferably, the slits 113 should terminate at a height "B" above the base material 112 that is one third to two thirds the total height "H" of the fletching 100 above the base material 112.

While the invention has been described in conjunction with the preferred embodiments, it will be understood that it is not intended to limit the invention to these embodiments. On the contrary, the invention is intended to cover alternatives, modifications and equivalents that may be included within the spirit and scope of the invention as defined by the appended claims.

What is claimed is:

1. An arrow fletching strip for attachment to an arrow shaft, comprising:

a portion of the vane of a bird's feather comprising barbs attached to a shaft that has been split along its length whereby the split shaft comprises a continuous base material; and multiple vane segments that are connected to the continuous base material and also connected to contiguous vane segments by the continuous base material, wherein the multiple vane segments are formed from the barbs by cutting notches into the barbs down to the continuous base material between adjacent vane segments to form vane segments and wherein each of the vane segments is shorter than a total length necessary to comprise a desired arrow fletching and wherein each of the vane segments can be added to or removed from another of the vane segments to form a longer fletching or a shorter fletching.

2. The arrow fletching strip according to claim 1 wherein the length of the arrow fletching strip can be determined by removing one or more of the vane segments.

3. The arrow fletching strip of claim 1 wherein the vane segments are shaped like fins.

4. The arrow fletching strip of claim 1 wherein the length of each of the vane segments is chosen so that each fletching comprises two or more repeating vane segments.

5. The arrow fletching according to claim 1 wherein the vane segments comprise identical lengths and shapes to facilitate symmetry between the fletchings to be attached to the arrow shaft.

6. The arrow fletching according to claim 1 wherein the vane segments may vary as to length and shape, provided that such segments are arranged in a repeating pattern.

7. An arrow fletching strip for attachment to an arrow shaft, comprising:

a continuous base material; and multiple vane segments that are connected to the continuous base material and also connected to contiguous vane segments by the continuous base material, wherein each of the vane segments is shorter than a total length necessary to comprise a desired arrow fletching and wherein each of the vane segments can be added to or removed from another of the vane segments to form a longer fletching or a shorter fletching;

wherein one or more of the vane segments has a top edge generally spaced from and opposed to the base material and one or more slits are defined in the vane segment extending from the top edge of the vane segment.

8. The arrow fletching strip of claim 7 wherein the one or more slits extend generally down from the top edge of the vane segment, the one or more slits have lower ends spaced from the top edge of the vane segment, and the lower ends are at a height above the base material that is about one third to two thirds the total height of the vane segment as measured above the base material.

9. The arrow fletching strip of claim 8 wherein each of the vane segments in the strip has one or more slits defined therein.

10. The arrow fletching strip according to claim 7 wherein the length of an arrow fletching strip can be determined by removing one or more of the vane segments.

11. The arrow fletching strip according to claim 7 wherein the vane segments are shaped like fins.

12. The arrow fletching strip according to claim 7 wherein the length of each of the vane segments is chosen so that each fletching comprises two or more repeating vane segments.

13. The arrow fletching according to claim 7 wherein the vane segments comprise identical lengths and shapes to facilitate symmetry between the fletchings to be attached to the arrow shaft.

14. The arrow fletching according to claim 7 wherein the vane segments may vary as to length and shape, provided that such segments are arranged in a repeating pattern.

15. A method for fletching an arrow comprising:

providing a segmented vane fletching material comprising a plurality of vane segments attached to a continuous base material, the vane segments and the continuous base material being made of synthetic material, at least one of the vane segments having a top edge generally spaced from and opposed to the base material and one or more slits defined in the one or more vane segments and extending from the top edge of the one or more vane segments;

attaching a length of said segmented vane fletching material to an arrow shaft; modifying said length of said segmented vane fletching material to achieve a desired fletching balance, wherein said modifying comprises adding or removing at least one of said plurality of vane segments.

* * * * *